US006113091A

United States Patent [19]

Mizubata et al.

[11] Patent Number: 6,113,091

[45] Date of Patent: Sep. 5, 2000

[54] AUTOMATIC DOCUMENT FEEDER

[75] Inventors: Tsuyoshi Mizubata; Tomohiro Morita, both of Hachioji; Osamu Kato, Higashimurayama, all of Japan

[73] Assignee: Konica Corporation, Tokyo, Japan

[21] Appl. No.: 08/956,668

[22] Filed: Oct. 23, 1997

[30] Foreign Application Priority Data

Oct. 29, 1996 [JP] Japan ..... 8-286716

[51] Int. Cl.[7] ..... B65H 5/22

[52] U.S. Cl. ..... 271/6; 271/4.06; 271/4.09; 271/7; 271/12; 271/10.07; 271/10.1

[58] Field of Search ..... 271/3.01, 3.14, 271/3.18, 4.01, 6, 4.06, 4.09, 7, 10.01, 12, 10.07, 10.1

[56] References Cited

U.S. PATENT DOCUMENTS 5,242,047 9/1993 Bonnet ..... 198/842
5,292,113 3/1994 Morigami et al. ..... 271/7
5,584,473 12/1996 Baba ..... 271/3.18

FOREIGN PATENT DOCUMENTS 58-38948 3/1983 Japan .

*Primary Examiner*—David H. Bollinger
*Attorney, Agent, or Firm*—Frishauf, Holtz, Goodman, Langer & Chick, P.C.

[57] ABSTRACT

An automatic document feeder for use with an image forming apparatus, for conveying a document on a platen of the apparatus, includes a rotating conveyance belt for pressing the document to the platen thereby conveying the document along the platen; a pressing roller for applying pressure to the rotating conveyance belt and subsequently onto the document. The pressing roller includes a plurality of rows of rollers in a conveying direction of the document, and each of the plurality of rows is provided with a plurality of the pressing rollers. Tracks in an axis direction of the plurality of pressing rollers followed by at least two rows are different from each other, so that the tracks pass over different portions of the conveyance belt with respect to the conveying direction.

3 Claims, 7 Drawing Sheets

FIG. 3 ( a )
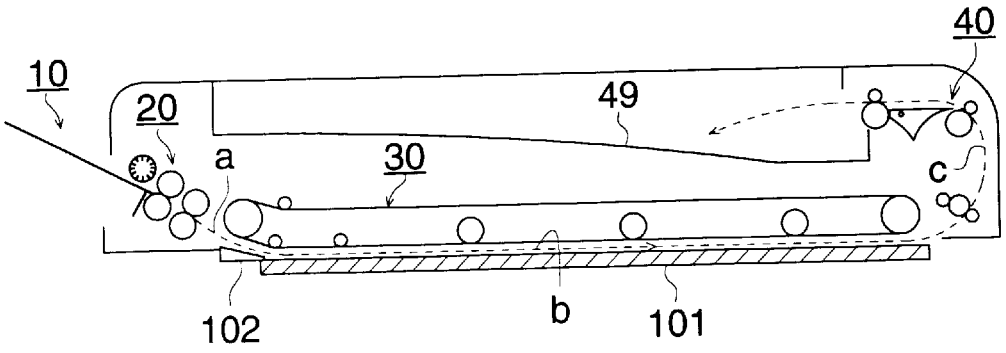
FIG. 3 ( b )
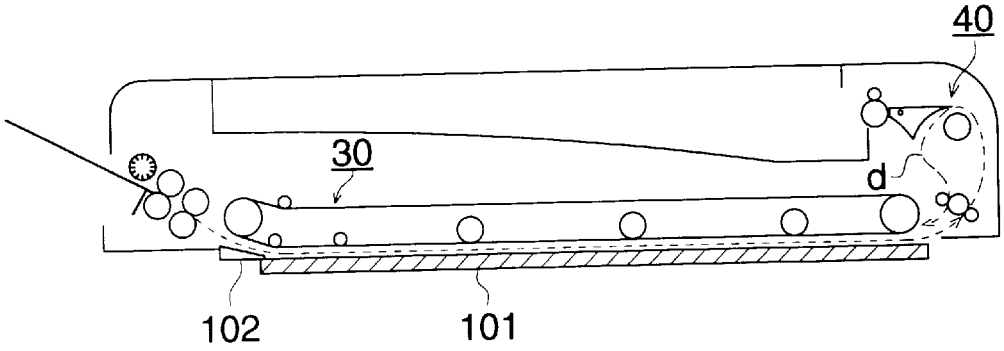
FIG. 3 ( c )
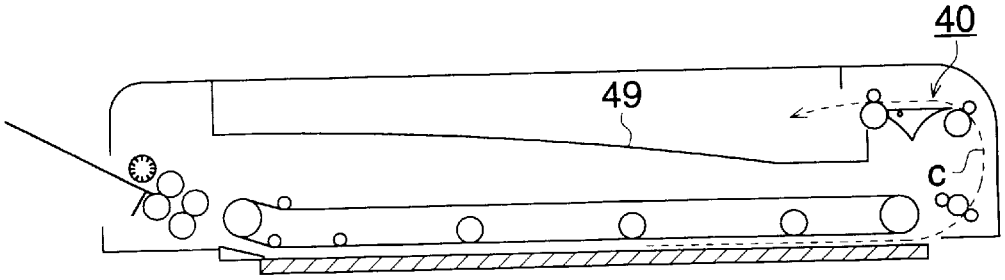

AUTOMATIC DOCUMENT FEEDER

BACKGROUND OF THE INVENTION

This invention relates to an automatic document feeder which is attached to recording appatuses such as electrophtographic copying machines, image reading devices and so forth, and in particular to an automatic document feeder wherein a document sheet on the document platen is transported with a revolving document transport belt pressing it.

Heretofore, in this type of automatic document feeders (Japanese Tokkai-sho 58-38948 etc), as shown in the perspective view of FIG. 7 for example, conveyor belt 1 is an endless belt, which is entrained about a drive roller 2 and an idle roller 3. A pluralty of rows of document pressing rollers are rotatably supported inside the conveyor belt 1. The document pressing rollers, arranged in up-to-downstream direction of the document platen, consist of the first row rollers 4A and 4B, the second row rollers 5A and 5B, and the third row rollers 6A and 6B; each of the document pressing rollers presses the inner side of the conveyor belt 1, which transports the document on the document platen glass plate (platen glass plate), and rotates driven by the conveyor belt.

The document pressing rollers 4A, 5A, and 6A are located at equivalent positions with respect to a direction perpendicular to the document conveyance direction respectively; they press the portions on the same track on the inner surface of the revolving conveyor belt. Also the document pressing rollers 4B, 5B, and 6B are located at equivalent positions with respect to the direction perpendicular to the document conveyance direction respectively, and press the portions on the same track on the inner surface of the revolving conveyor belt. Therefore, these plural rows of document pressing rollers 4A to 6A, 4B to 6B press always the same track portions of the revolving conveyor belt 1, so they have the defect that the track portions pressed by document pressing rollers of the conveyor belt 1 become locally smudged or damaged.

SUMMARY OF THE INVENTION

This invention has been made in order to solve the above described problem, and an object is to prolong the life of the conveyor belt by preventing the track portions of the conveyor belt pressed by the document pressing rollers of the same type from being locally smudged or damaged. Another object of the invention is to prevent copied images from having a dirty background due to a smudged conveyor belt. A further object of the invention is to prevent poor document transport due to a damaged conveyor belt.

An automatic document feeder according to this invention to accomplish the above-mentioned objects is a document feeder of the type wherein a document sheet on the document platen plate is transported with a revolving conveyor belt pressing it, and is characterized in that the document pressing rollers pressing the document conveyor belt comprise of plural rows of rollers arranged in the direction of document transport, and a pluralty of document pressing rollers are arranged in each of the rows of rollers, and the document pressing rollers in one row are located on their shaft at the positions different from those on the shaft of another row so that the pressing rollers in one row trace the tracks different from those by the rollers of another row in the document transport direction on the inner surface of the document conveyor belt.

Further, the invention is characterized in that the document pressing rollers in the above-mentioned automatic document feeder comprise of rollers having the same width, and made of the same material.

Furthermore, the invention is characterized in that each of the document pressing rollers is urged by means of an elastic member.

BRIEF DESCRIPTION OF THE DRAWINGS

FIGS. 3(*a*)–3(*c*) are schematic illustrations showing an ADF mode wherein a document with an image on only one side of is copied and an R-ADF mode wherein a document with images on both sides is copied.

DETAILED DESCRIPTION OF THE PREFERRED EMBODIMENT

Hereinafter an embodiment of the automatic document feeder of this invention will be disclosed with reference to the attached drawings.

Figure 1:
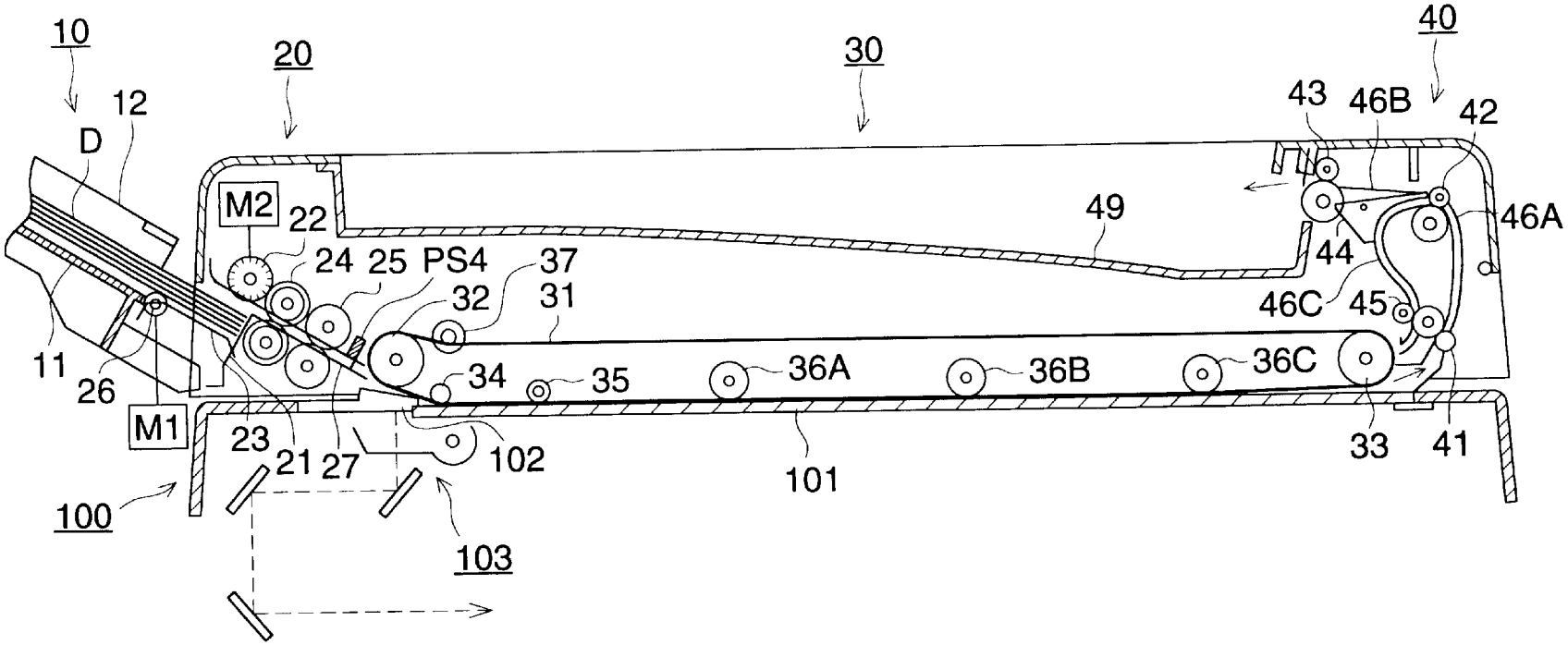
FIG. 1 is a cross-sectional view of an automatic document feeder to which this invention is applicable.
Figure 2:
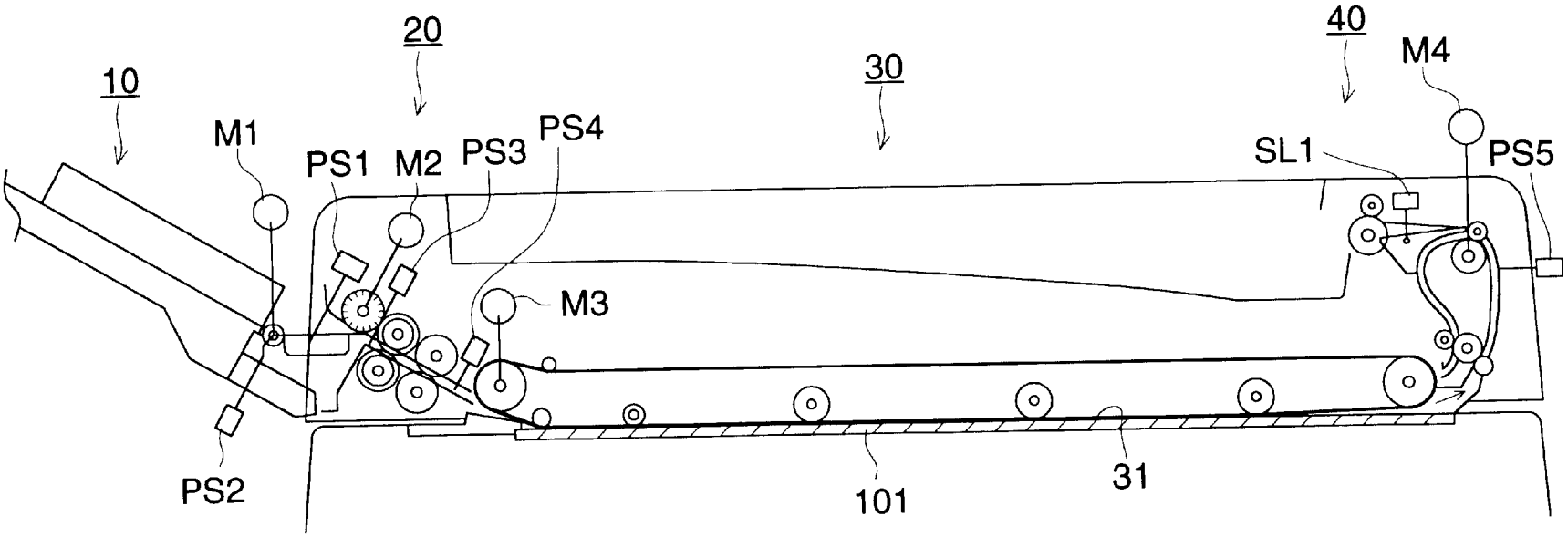
FIG. 2 is a cross-sectional view of the automatic document feeder showing the composition of the drive system.

FIG. 1 is a cross-sectional view of an automatic document feeder to which this invention is applicable. FIG. 2 is a cross-sectional view of the automatic document feeder showing the composition of the drive system.

The automatic document feeder shown in the drawings has following two functions. In the first mode(hereinafter referred to as the ADF mode), wherein single-sided document sheets are automatically fed, an original document D comprising plural sheets(single-sided or double-sided) is placed on the document setting base 11 of the setting station(the portion to be loaded with a document) 10 to be fed by the paper feed mechanism 20, each sheet being transported by the transport mechanism 30, next subjected to the exposure process on the platen glass plate(document support plate) 101 of the image reading device mainframe or the copying machine mainframe, then delivered to the exit tray 49 by the discharge mechanism 40. In the second mode(hereinafter referred to as the R-ADF mode), wherein double-sided document sheets are automatically fed, the document sheet D, after being subjected to the exposure process, is once discharged from the document platen plate 101 to be inverted upside-down, transported again onto the document platen 101 to be exposed, and then delivered to the discharge tray 49.

The automatic document feeder comprises the setting station 10, the feed mechanism 20, the transport mechanism 30, and the discharge mechanism 40.

The setting station 10 is mounted to the automatic document feeder mainframe, and comprises of the document setting base 11 whereon document sheets are to be set and a pair of side regulating plates 12 which are movable sideways to fit the document width and regulates the side edges of the loaded document sheets.

Beyond the front edge, that is, downstream side edge in the document feeding direction, of the above-mentioned document setting base 11, the document leading edge stopper 21 is fixed to the automatic document feeder mainframe. A stack of document sheets to be loaded first is loaded on the document setting base 11 of the setting station 10 and the movable pressing-up plate 23, pushed sideways to be in contact with the side regulating plates 12 which determine the document position in the width direction in accordance with either the side- or the center-reference basis, while on the other hand, the leading edges of the document sheets are trued up correctly, pushed to the document leading edge stopper 21.

The presence or absence of a document is detected by the document loading detect sensor(no document sheet detect sensor) PS1, and ADF-mode sign is indicated on the control panel of the copying machine mainframe 100.

At the document-feed-downstream side of the above-mentioned setting station 10, there are provided the separate-to-feed roller(the pick-off roller) 22 and the movable pressing-up plate 23 which is able to contact or spaced apart from the periphry of the separate-to-feed roller 22. The roller 22, as well as two pairs of feed-in rollers 24 and 25 which are located at farther document-feed-downstream site, are driven to rotate by the paper feed moter M2. The movable pressing-up plate 23 is driven by the pressing moter M1 and able to swing around a pivot 26. The lower-most position(the initial position) of the movable pressing-up plate 23 is detected by the home position(HP) sensor PS2.

Along the document feed course provided with the afore-the separate-to-feed roller 22 and two pairs of feed-in rollers 24 and 25, there is also provided a pair of, upper and lower, guide plates 27, which forms the path for feeding the document sheet D fed out of the pressed position by the separate-to-feed roller 22 and the movable pressing-up plate 23 to one end of the platen glass plate 101.

At an upstream side of the path for feeding the document, there is provided the sensor PS3 which detects a document D of A5R size. And also at a predetermined position located in the downstream side of the path, the position being also downstream of the pair of feed-in rollers 25, there is provided the document pass detecting sensor(hereinafer refered to as the paper feed sensor) PS4.

Above the platen glass plate 101, there is provided the transport mechanism 30. The conveyor belt 31 is entrained to be able to revolve about the drive roller 32, the follower roller 33, the document pressing rollers 34, 35, 36A, 36B, and 36C located at five different positions respectively, and the tensioning roller 33A. The drive roller 32 operates in the normal- or reverse-rotation mode under the driving force of the transport motor M3. Other rollers 33–36C are idlers.

Among the document pressing rollers 34, 35, 36A, 36B, and 36C, the document pressing rollers 36A, 36B, and 36C comprise the same type of rollers having the same width.

The document pressing roller 34 is provided in close vicinity of the document stopper 102 which is mounted at one end of the platen glass plate 101, and forms a small clearance between the conveyor belt 31 and the platen glass plate 101.

The document pressing roller 35 is urged by means of an elastic member, that is, a plate spring made of metal to press the conveyor belt 31 to the platen glass 101.

The document pressing rollers 36A, 36B, and 36C are urged by their own weight or by means of an elastic member to press the conveyor belt 31 to the platen glass plate 101. For securing enough pressure, it is desirable to be urged by means of an elastic member. It is desirable that the elastic member is a spring made of metal for durability, and in this invention a plate spring is used.

The tensioning roller 37 keeps the tension of the conveyor belt 31 constant, and moreover prevents the deflection (moving in a zigzag direction) of the conveyor belt 31.

The drive roller 32 for driving the conveyor belt 31 to revolve is connected to the drive system composed of the transport motor M3, the transport clutch, the transport brake, and so forth.

The document sheet D fed from the feed mechanism 20 into the transport mechanism 30 is transported by the revolving conveyor belt 31 to pass on the platen glass plate 101, and at a predetermined time after the detection of the passing through of its trailing edge, stops with a temporary stopping of the revolving of the conveyor belt 31. Immediately after the stopping, the conveyor belt 31 revolves in a reverse direction until it causes the trailing edge of the document sheet D to contact the stopper 102. While the document sheet D is stationary, the image on its front side is read with the scanning of the exposure optical system. After the exposure is finished, the document sheet D is delivered to the discharge means 40.

The discharge mechanism 40 comprises of the intermediate discharge roller pairs 41 and 42, the discharge roller pair 43, the switching fingers 44, the reverse transport roller pair 45, and the guide plates 46A, 46B, and 46C, and so forth. The intermediate discharge roller pairs 41 and 42, the discharge roller pair 43, and the reverse transport roller pair 45 is driven with the discharge motor M4. Further, the switching fingers 44 are driven with the discharge solenoid SL1.

In the upper part of the automatic document feeder and outside the opening of the discharge mechanism 40, there is provided fixedly the exit tray 49.

The document D delivered to the first intermediate discharge roller pair 41 of the discharge mechanism 40 by the conveyor belt 31 passes through the path of the guide plates 46A, and its leading edge is detected by the discharge sensor PS5 when passing, next it is transported, held between the second intermediate discharge roller pair 42, to pass, in the case of the ADF mode for single-sided documents, through the path between the guide plate 46B and the upper side of the switching fingers 44, and finally delivered out of the feeder body, held between the discharge roller pair 43 to be put on the exit tray 49. The discharge sensor PS5 detects both the pass of the document leading edge and jamming of the document sheet when occurred.

In the R-ADF mode for double-sided documents, the switching fingers 44 are driven with the solenoid SL1 to change the transport course of the document sheet D. The document sheet D is transported, held between the second intermediate discharge roller pair 42, to pass through the guide plates 46C, then, held first between the reverse transport roller pair 45, next between the conveyor belt 31 which is changed in the reverse revolving mode and the platen glass plate 101, moves in the reverse direction until it is stopped by hitting the document stopper 102. As the document sheet D is in this stationary condition, the image on its rear side is read with the scanning of the exposure optical system 103. After the exposure is finished, the document sheet D is discharged out of the feeder body by the discharge mechanism 40 in the same manner as in the case of the ADF mode.

FIGS. 3(*a*), 3(*b*), and 3(*c*) are the schematic illustrations showing the document transport paths(broken lines) in the two modes.

FIG. 3(*a*) is a schematic illustration showing the ADF mode wherein the single-sided document sheet D is copied and discharged out of the feeder body onto the exit tray 49. The document sheet D is fed from the setting station 10, passing through the course a in the feed mechanism 20 and the course b in the transport mechanism 30, then discharged from the course C in the discharge mechanism 40 to outside the feeder body, where it is put and accomodated in the exit tray 49.

FIGS. 3(*b*) and 3(*c*) are the schematic illustrations showing the R-ADF mode wherein a double-sided document sheet D is copied and discharged out of the feeder body onto the exit tray 49. The double-sided document sheet D first passes through the course a, b, and c set forth in the above, subjected to the exposure process on the first side of the sheet in the meantime, then, after being inverted in the reverse discharge course d in the discharge mechanism 40, moves in the reverse direction on the platen glass plate 101 through the course b in the transport mechanism 30, until it is stopped by hitting the document stopper 102. As the document is in this stationary condition, its second side is subjected to the exposure process. Thus the document sheet D which has been exposed on both sides passes through the same course as shown in the drawing FIG. 3(*a*) and is put onto the exit tray 49 to be accomodated in it.

Hereinafter, the explanation regarding the means for pressing the conveyor belt of the automatic document feeder relating to this invention will be given.

Figure 4:
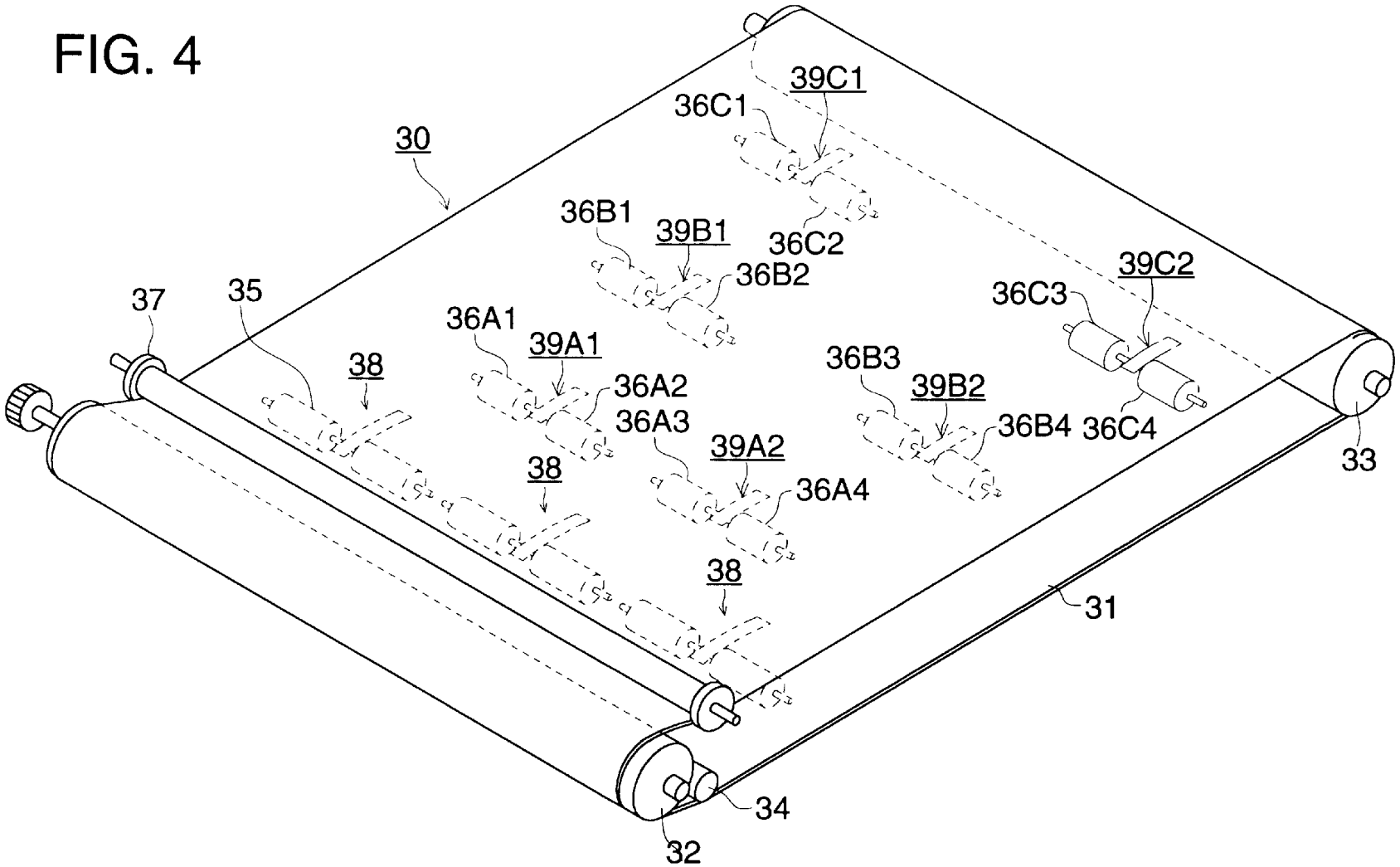
FIG. 4 is a perspective view of the transport system of the automatic document feeder of this invention.
Figure 5:
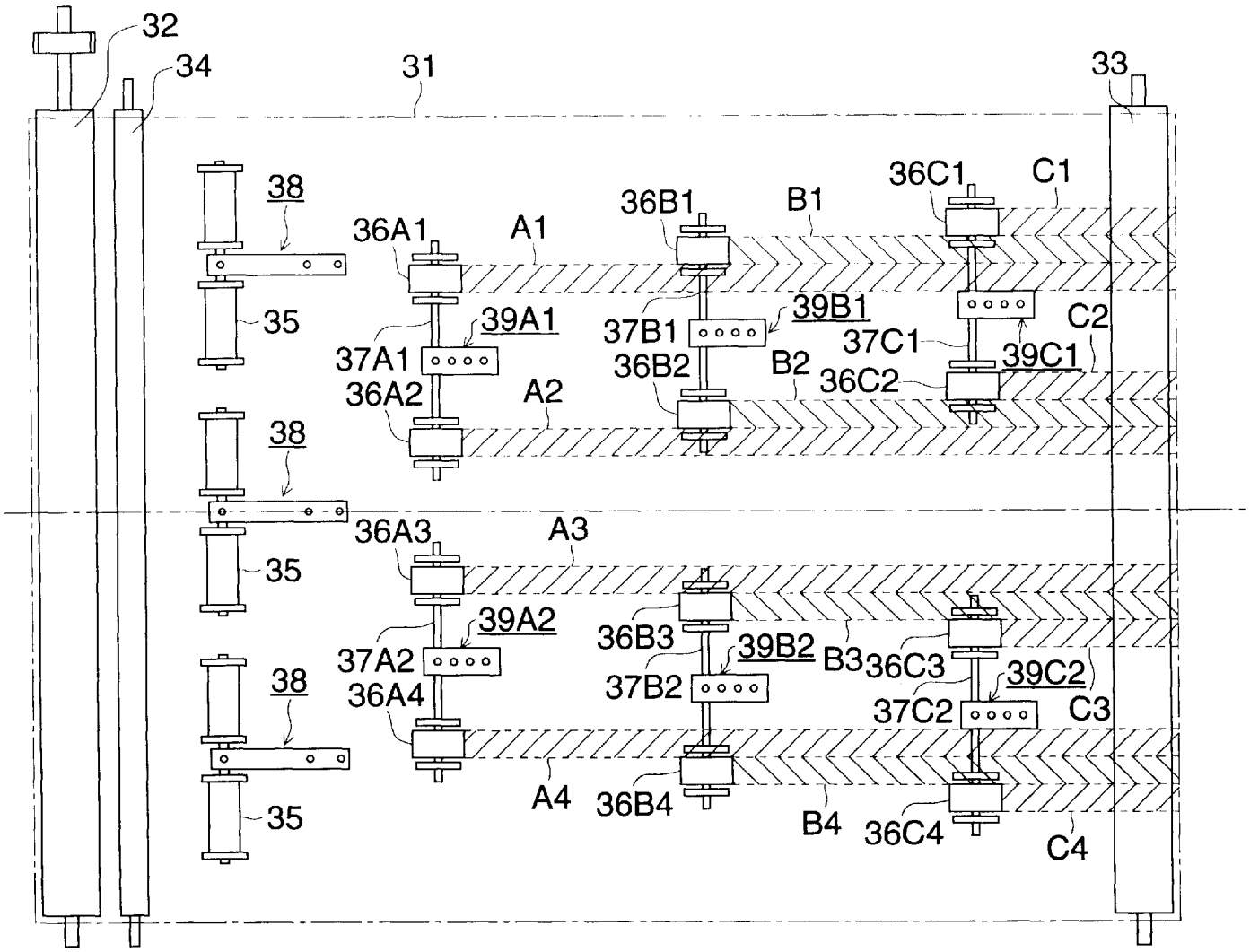
FIG. 5 is the plan of the transport system.

FIG. 4 is the perspective view of the transport mechanism 30 of the automatic document feeder by this invention. FIG. 5 is the plan of the transport mechanism.

Among the plural rows of pressing rollers arranged inside the endlessly-shaped conveyor belt 31 of the transport mechanism 30, the document pressing roller 35 located at the uppermost stream in the document transport direction is urged resiliently with the elastic member 38, the pressing means for the conveyor belt, to press the conveyor belt 31 to cause it to be in contact with the platen glass plate 101.

The plural rows of document pressing rollers 36A, 36B, and 36C are all of the same type and each of them is urged with its own weight or an elastic member to press the conveyor belt 31 to cause it to be in contact with the platen glass plate 101.

The first row pressing rollers 36A, positioned at the first of the three up-to-downstream of the document transport, comprise the rollers 36A1 and 36A2 which are mounted to the roller shaft 37A1, and rollers 36A3 and 36A4 mounted to the roller shaft 37A2.

The second row pressing rollers 36B, positioned at the second up-to-downstream, comprise the rollers 36B1 and 36B2 which are mounted to the roller shaft 37B1, and rollers 36B3 and 36B4 mounted to the roller shaft 37B2.

The third row pressing rollers 36C, positioned at the third up-to-downstream, comprise the rollers 36C1 and 36C2 which are mounted to the roller shaft 37C1, and rollers 36C3 and 36C4 mounted to the roller shaft 37C2.

The above-mentioned rollers 36A1, 36B1, and 36C1 are located at the staggered positions on their shafts so that the tracks A1, B1, and C1 on the conveyor belt 31 by the first, second, and third row rollers 36A1, 36B1, and 36C1 respectively, the tracks A1, B1, and C1 having the width of the rollers 36A1, 36B1, and 36C1 respectively, may not overlap one another.

In the same manner as the above, the above-mentioned rollers 36A2, 36B2, and 36C2 are located at the staggered positions on their shafts so that the tracks A2, B2, and C2 by the first, second, and third row rollers 36A2, 36B2, and 36C2 respectively, the tracks A2, B2, and C2 having the width of the rollers 36A2, 36B2, and 36C2 respectively, may not overlap one another.

Further likewise, the above-mentioned rollers 36A3, 36B3, and 36C3 are located at the staggered positions on their shafts so that the tracks A3, B3, and C3 by the first, second, and third row rollers 36A3, 36B3, and 36C3 respectively, the tracks A3, B3, and C3 having the width of the rollers 36A3, 36B3, and 36C3 respectively, may not overlap one another.

Still further likewise, the above-mentioned rollers 36A4, 36B4, and 36C4 are located at the staggered positions on their shafts so that the tracks A4, B4, and C4 by the first, second, and third row rollers 36A4, 36B4, and 36C4 respectively, the tracks A4, B4, and C4 having the width of the rollers 36A4, 36B4, and 36C4 respectively, may not overlap one another.

In addition, although the rollers 36A1, 36B1 and 36C1 are arranged at staggered positions one another in the above-mentioned embodiment, so that the tracks A1, B1, and C1 may not overlap one another, the tracks may have some overlapped portions. Moreover, any one of the rollers 36A1, 36B1, and 36C1 may be positioned in such a way as the corresponding track have a little spacing to the adjacent track. Also any one of the tracks A2, B2, and C2 may have a little overlap with or a spacing to another. In the same way, any one of the tracks A3, B3, and 03, or A4, B4, and C4 may have a little overlap with or a spacing to another.

In this manner, because of such an arrangement of the rollers of the same type as they do not press substantially the same track portion on the revolving conveyor belt 31 in any case, the track portions by the plural rollers 36A1–364, 36B1–36B4, and 36C1–36C4 do not substantially overlap on the conveyor belt 31, therefore the conveyor belt is prevented from being locally smudged or damaged, resulting in the prolonging of the life of the conveyor belt, the prevention of the copied images from having smudged background due to the smudged belt, and also the prevention of poor transport performance due to a damaged belt.

Figure 6:
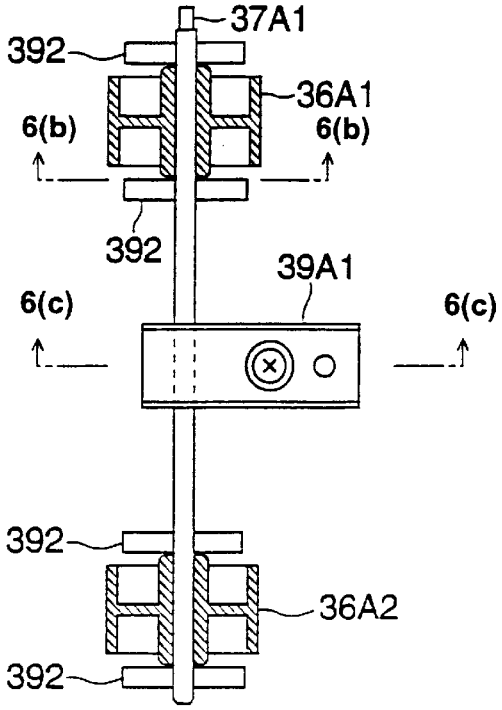
FIG. 6(*a*) is a plan view of the document pressing roller, FIG. 6(*b*) is a cross-sectional view at section line 6(*b*)—6(*b*), and FIG. 6(*c*) is a cross-sectional view at section line 6(*c*)—6(*c*).
Figure 6:
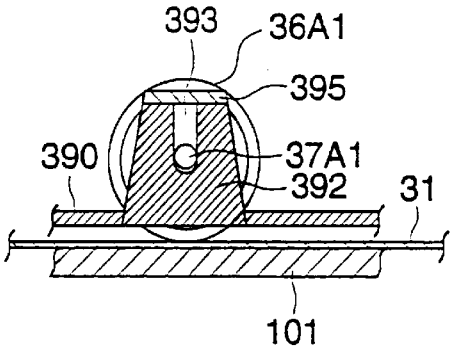
Figure 6:
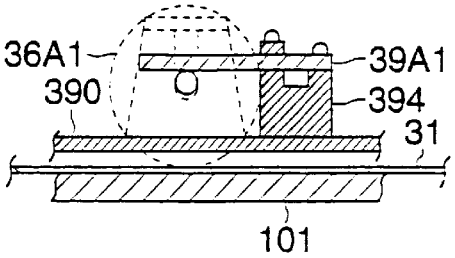
Figure 7:
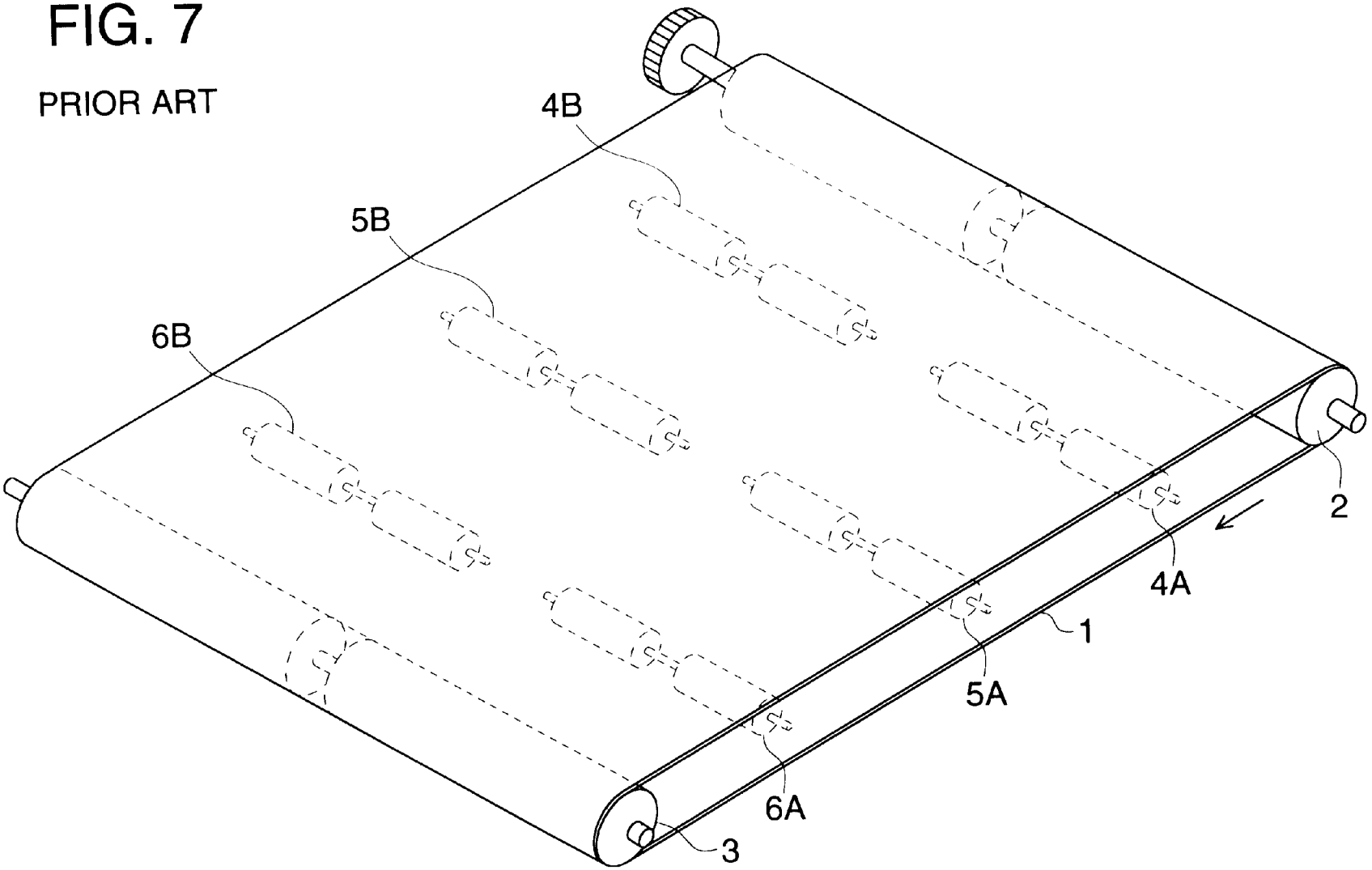
FIG. 7 PRIOR ART
FIG. 7 is a perspective view showing the transport system of an automatic document feeder heretofore in use.

Referring now to FIGS. 6(*a*), 6(*b*) and 6(*c*), the rollers 36A1–36A4, 36B1–36B4, 36C17–36C4 have the same structure and the elastic members 39A1, 39A2, 39B1, 39B2, 39C1, and 39C2 too. Therefore, the explanation will be given with reference only to the rollers 36A1 and 36A2 and the elastic member 39A1 as the representatives in the following.

The rollers 36A1 and 36A2 are rotatably mounted at the positions close to both ends of the support shaft 37A1. The portions adjacent to the ends are inserted in the slots 393 of the bearing members 392, and movable vertically in the slots but the moving is upwardly limited with a holding-back plate 395 for the shafts not to go out of the slots. The central portion of the shaft 37A1 is urged with the elastic member 39A1 which is fixed to a projected portion protruded out of the base plate 390, so the rollers 36A1 and 36A2 press the conveyor belt 31 by their own weight and the urging force due to the elastic member. It is desirable that the elastic member is a spring made of metal in view of long durability, and in this example, a plate spring made of metal is used.

Moreover, the arrangement, the number and the width of the rollers are not confined to the embodiment.

In the present embodiment, five rows of the document pressing rollers 34, 35, 36A, 36B and 36C are disposed in the document conveyance direction, as shown in FIG. 5. The document pressing rollers 36A, 36B and 36C among the five rows of the document pressing rollers are arranged so that the tracks of the document pressing rollers 36A, 36B and 36C are not overlapped with each other. However, when at least two rows of the document pressing rollers are arranged so that the tracks of the two rows of the document pressing rollers pass over different portions from each other of the conveyance belt with respect to the conveying direction, the reduction of the conveyor belt smudge can be achieved, compared with that in the conventional automatic document feeder.

The automatic document feeder of the present invention accomplishes the prolonging of the life of the conveyor and the prevention of the copied images from having a smudged background due to the smudged belt, through such arrangement of the document pressing rollers which press the conveyor belt so that they do not press substantially the same track portion on the revolving conveyor belt 31 in any case, resulting in the prevention of the conveyor belt from being locally smudged or damaged.

What is claimed is:

1. An automatic document feeding apparatus for use with an image forming apparatus, for conveying a document on a platen of the image forming apparatus, the automatic document feeding apparatus comprising:

(a) a rotating conveyance belt for pressing the document to the platen of the image forming apparatus thereby conveying the document a long the platen; and (b) a plurality of pressing rollers arranged in a conveying direction of the document for applying pressure to the rotating conveyance belt and subsequently onto the document, wherein the plurality of pressing rollers comprise a plurality of rows of rollers in the conveying direction of the document, and wherein end pressing rollers at end positions in a direction perpendicular to the conveying direction of the document in each of the plurality of rows of rollers are provided at different positions in the direction perpendicular to the conveying direction of the document, so that tracks formed by respective ones of the end pressing rollers on the rotating conveyance belt are different from each other.

2. The automatic document feeding apparatus of claim 1, wherein the plurality of rollers have a same width in the direction perpendicular to the conveying direction of the document and are made of a same kind of material.

3. The automatic document feeding apparatus of claim 1, further comprising resilient members each for urging a respective one of the plurality of rollers toward the rotating conveyance belt.

* * * * *